US012653360B2

(12) United States Patent
Ye et al.

(10) Patent No.: US 12,653,360 B2
(45) Date of Patent: Jun. 16, 2026

(54) HANDHELD ELECTRIC CLEANER

(71) Applicant: NINGBO BRIGHTECH INTERNATIONAL TRADING CO., LTD., Yuyao City (CN)

(72) Inventors: Jun Ye, Yuyao City (CN); Jinqi Lu, Yuyao City (CN); Pingting Tang, Yuyao City (CN); Yuzhu Fang, Yuyao City (CN)

(73) Assignee: NINGBO BRIGHTECH INTERNATIONAL TRADING CO., LTD, Yuyao City (CN)

( * ) Notice: Subject to any disclaimer, the term of this patent is extended or adjusted under 35 U.S.C. 154(b) by 309 days.

(21) Appl. No.: 18/429,934

(22) Filed: Feb. 1, 2024

(65) Prior Publication Data

US 2025/0204733 A1 Jun. 26, 2025

(30) Foreign Application Priority Data

Dec. 22, 2023 (CN) ..... 202323509628.8

(51) Int. Cl.

| | |
|---|---|
| ***A46B 7/04*** | (2006.01) |
| ***A47L 7/00*** | (2006.01) |
| ***A47L 9/06*** | (2006.01) |
| ***A47L 9/24*** | (2006.01) |
| ***A47L 9/28*** | (2006.01) |
| ***A47L 9/32*** | (2006.01) |

(52) U.S. Cl.

CPC ..... *A47L 7/0023* (2013.01); *A46B 7/04* (2013.01); *A47L 7/0019* (2013.01); *A47L 7/0042* (2013.01); *A47L 9/0606* (2013.01); *A47L 9/0673* (2013.01); *A47L 9/248* (2013.01); *A47L 9/2884* (2013.01); *A47L 9/322* (2013.01); *A46B 2200/3033* (2013.01)

(58) Field of Classification Search

CPC ... A47L 9/248; A47L 9/14; A47L 5/24; A46B 7/04

See application file for complete search history.

(56) References Cited

U.S. PATENT DOCUMENTS

| | | | | |
|---|---|---|---|---|
| 2019/0008343 | A1* | 1/2019 | Conrad | A47L 9/246 |
| 2020/0281432 | A1* | 9/2020 | Yamada | A47L 9/04 |
| 2022/0151446 | A1* | 5/2022 | Conrad | A47L 9/1666 |
| 2024/0122419 | A1* | 4/2024 | Ye | A47L 5/14 |
| 2025/0366680 | A1* | 12/2025 | Ye | A47L 7/0066 |

* cited by examiner

*Primary Examiner* — Michael D Jennings

(74) *Attorney, Agent, or Firm* — Ladas & Parry, LLP

(57) ABSTRACT

A handheld electric cleaner is provided, including: a housing, a motor, a battery, a sewage tank, and further including a water suction opening and an air outlet on the sewage tank, and a water suction channel inside the sewage tank, the water suction channel is arranged to include a rear channel, a middle channel, and a front channel that are sequentially in communication. Moreover, the rear channel runs through a bottom surface of the sewage tank to form the water suction opening, the middle channel is in communication with the front channel through a side channel inside the sewage tank, and the front channel runs through a top surface of the sewage tank to form the air outlet. The sewage tank is further detachably configured at a bottom of the housing, and the motor is transversely arranged and mounted at a front part of the housing.

10 Claims, 6 Drawing Sheets

HANDHELD ELECTRIC CLEANER

CROSS-REFERENCE TO RELATED APPLICATION

The present disclosure relates to and claims priority to Chinese patent application No. CN 202323509628.8 filed on Dec. 22, 2023 in China, the disclosure of which is incorporated herein by reference in its entirety.

TECHNICAL FIELD

The present invention relates to a cleaner, and in particular, to a handheld electric cleaner.

BACKGROUND

In daily life, after a surface of a fabric sofa is stained with sewage, if the sewage is wiped directly with a rag, it is easier for the sewage to permeate into the fabric material and form a stain. Therefore, a handheld electric cleaner dedicated to electricity-powered water suction has been launched in the market to resolve the foregoing problem, and its structure mainly includes a housing, a motor and a battery inside the housing, and a sewage tank outside the housing. The sewage tank is provided with a water suction opening and an air outlet, and a water suction channel that is in communication with the water suction opening and the air outlet respectively is arranged inside the sewage tank. The air outlet of the sewage tank is in sealed communication with an air suction opening of the motor, and provides a negative-pressure suction force for an interior of the water suction channel. Further, the sewage can be sucked into the sewage tank from the water suction opening through the negative-pressure suction force, that is, the sewage is removed directly from the surface of the fabric sofa. However, water suction channels of the existing handheld electric cleaners are each merely a simple straight-through channel. Due to an excessively short and particularly simple suction path, in actual use, some water vapor is likely to be directly sucked into an air suction opening and corrode internal devices of a motor, which severely affects the use reliability of the handheld electric cleaner and shortens the service life. In addition, the existing handheld electric cleaners each have a motor vertically arranged at a rear part of a housing and a sewage tank mounted at a front part of the housing. Such a structure has a poor overall layout and has effects such as a bulky size and an ugly appearance.

SUMMARY

The technical problem to be resolved by the present invention is to overcome shortcomings in the prior art and provide a handheld electric cleaner with a compact structure, a small volume, a beautiful appearance, use reliability, and a long service life.

The technical problem of the present invention is resolved through the following technical solutions.

A handheld electric cleaner is provided, including: a housing, a motor and a battery inside the housing, and a sewage tank outside the housing. The sewage tank is provided with a water suction opening and an air outlet, a water suction channel that is in communication with the water suction opening and the air outlet respectively is arranged inside the sewage tank, and the air outlet of the sewage tank is in sealed communication with an air suction opening of the motor, and provides a negative-pressure suction force for an interior of the water suction channel. The water suction channel includes a rear channel, a middle channel, and a front channel that are sequentially in communication. The rear channel runs through a bottom surface of the sewage tank to form the water suction opening. The middle channel is in communication with the front channel through a side channel inside the sewage tank, and the front channel runs through a top surface of the sewage tank to form the air outlet.

The rear channel includes a water suction pipe vertically arranged on an inner bottom surface of the sewage tank and side plates arranged on an inner top surface of the sewage tank and located on two sides of the water suction pipe, a water suction hole axially running through the water suction pipe is provided inside the water suction pipe, a lower end of the water suction hole runs through the bottom surface of the sewage tank to form the water suction opening, and water suction gaps are formed between the side plates and the water suction pipe. The rear channel is an inverted U-shaped trajectory channel formed together by the water suction opening, the water suction hole, and the water suction gaps that are sequentially in communication.

For the middle channel, a plurality of spacers are sequentially arranged along a horizontal direction in a middle part of the sewage tank, a compartment is formed between every two adjacent spacers, communication is formed between every two adjacent compartments through a spacing at a top of the spacer, and a baffle is arranged inside every compartment.

The front channel is a U-shaped pipe arranged inside the sewage tank, the side channel is formed between the U-shaped pipe and an inner sidewall of the sewage tank, one end opening of the U-shaped pipe runs through the top surface of the sewage tank to form the air outlet, and an other end opening of the U-shaped pipe is in communication with the side channel.

An air suction channel is arranged inside the housing, and the air suction channel is in communication with the air suction opening of the motor and the air outlet of the sewage tank respectively.

The air suction channel is a "⌈"-shaped channel formed together by a vertical channel in communication with the air outlet and a horizontal channel in communication with the air suction opening.

An embedded and fixed sealing plug is arranged at the air outlet of the sewage tank, and the air outlet is in sealed communication with the air suction channel through the sealing plug.

The sewage tank is detachably configured at a bottom of the housing, and a cleaning brush that is detachably mounted is arranged at a bottom of the sewage tank.

The motor is transversely arranged and mounted at a front part of the housing, and an air exhaust opening of the motor is provided on a side surface of the front part of the housing. A grip for a hand to hold is formed at a rear part of the housing, and a motor switch for starting the motor and a charging port for charging a battery are arranged at a rear part of the grip. The battery is transversely arranged and mounted inside the grip.

A front sealing ring is arranged at a front part of the motor, a rear sealing ring is arranged at a rear part of the motor, and the motor is sealingly mounted inside the housing through the front and rear sealing rings.

Compared with the prior art, the present invention is mainly to design the water suction channel to include the rear channel, the middle channel, and the front channel that are sequentially in communication. Moreover, the rear channel runs through the bottom surface of the sewage tank to form the water suction opening. The middle channel is in communication with the front channel through the side channel inside the sewage tank, and the front channel runs through the top surface of the sewage tank to form the air outlet. In this way, a suction path of the water suction channel is lengthened while internal structures of the rear channel, the middle channel, and the front channel are also designed uniquely, to better prevent water vapor in the sewage tank from being directly sucked into the air suction opening and corroding internal devices of the motor, thereby ensuring the use reliability of the handheld electric cleaner and extending a service life. In addition, the sewage tank is detachably configured at the bottom of the housing, and the motor is transversely arranged and mounted at the front part of the housing, so that the structural design is more compact, which reduces the volume and also ensures the beauty of the appearance design.

DETAILED DESCRIPTION

Figure 1:
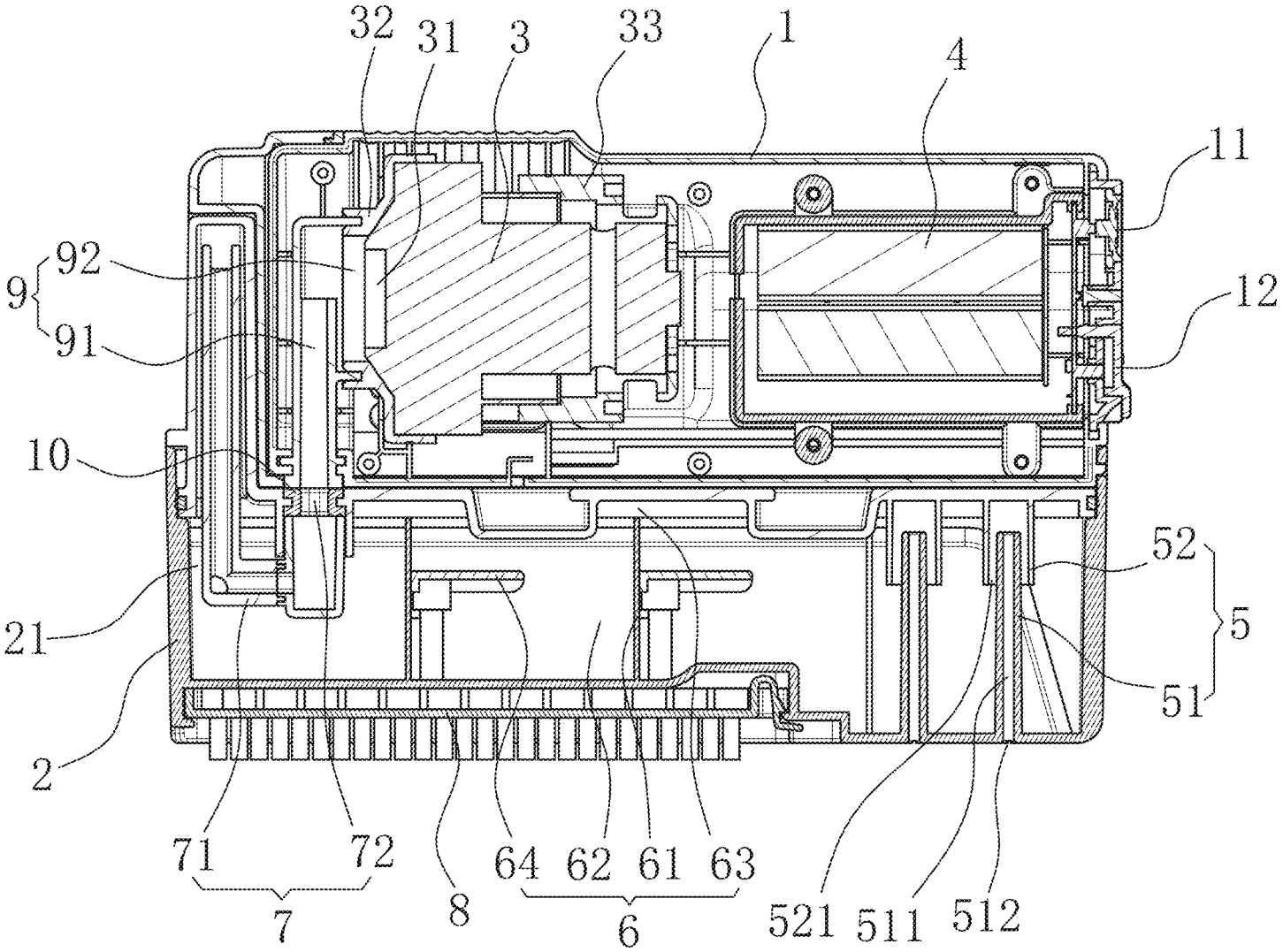
FIG. 1 is a schematic cross-sectional structural view of the present invention.

The embodiments of the present invention are further described below in detail with reference to the foregoing accompanying drawings.

As shown in FIG. 1 to FIG. 6, there following reference signs are provided: 1. housing, 11. motor switch, 12. charging port, 13. grip, 2. sewage tank, 21. side channel, 22. disassembly button, 23. label, 3. motor, 31. air suction opening, 32. front sealing ring, 33. rear sealing ring, 34. air exhaust opening, 4. battery, 5. rear channel, 51. water suction pipe, 511. water suction hole, 512. water suction opening, 52. side plate, 521. water suction gap, 6. middle channel, 61. spacer, compartment, 63. spacing, 64. baffle, 7. front channel, 71. U-shaped pipe, 72. air outlet, 8. cleaning brush, 9. air suction channel, 91. vertical channel, 92. horizontal channel, 10. sealing plug.

A handheld electric cleaner, as shown in FIG. 1 to FIG. 6, may be configured to electrically suck sewage on a surface of a fabric sofa, and may also remove sewage on a surface of another item. A structure of the handheld electric cleaner mainly includes a housing 1, a motor 3, a battery 4 inside the housing, and a sewage tank 2 outside the housing. This embodiment uses a left side of the view shown in FIG. 1 as a front part of the handheld electric cleaner, and a right side of the view as a rear part of the handheld electric cleaner.

The motor 3 is transversely arranged and mounted at a front part of the housing 1. Specifically, a front sealing ring 32 is arranged at a front part of the motor 3, and a rear sealing ring 33 is arranged at a rear part of the motor. The motor 3 is sealingly mounted inside the housing 1 through the front and rear sealing rings, and an air exhaust opening 34 of the motor is provided on a side surface at a front part of the housing. A grip 13 for a hand to hold is formed at a rear part of the housing 1, and a motor switch 11 for starting the motor 3 and a charging port 12 for charging the battery 4 are arranged at a rear part of the grip 13. The battery 4 is also transversely arranged and mounted inside the grip 13. It is apparent that such a position layout not only ensures the compactness of the structural design, leading to a smaller volume, but also ensures the beauty of the appearance design.

The sewage tank 2 is made of a transparent plastic material, to help a user to directly view a sewage capacity, which is convenient for subsequent cleaning. The sewage tank 2 is detachably configured at a bottom of the housing 1 and is flush with the housing in a length direction, thereby not affecting compactness of an overall appearance while ensuring a maximum use volume. A cleaning brush 8 that is detachably mounted is further arranged at a bottom of the sewage tank 2, and can brush away a stubborn stain on a surface of an item. In the detachable structure of this embodiment, the cleaning brush 8 is detachably mounted in a buckling manner in a mounting groove on a bottom surface of the sewage tank 2 using an elastic buckle.

The sewage tank 2 is provided with a water suction opening 512 and an air outlet 72. A water suction channel that is in communication with the water suction opening 512 and the air outlet 72 respectively is arranged inside the sewage tank 2. The water suction channel includes a rear channel 5, a middle channel 6, and a front channel 7 that are sequentially in communication.

Figure 2:
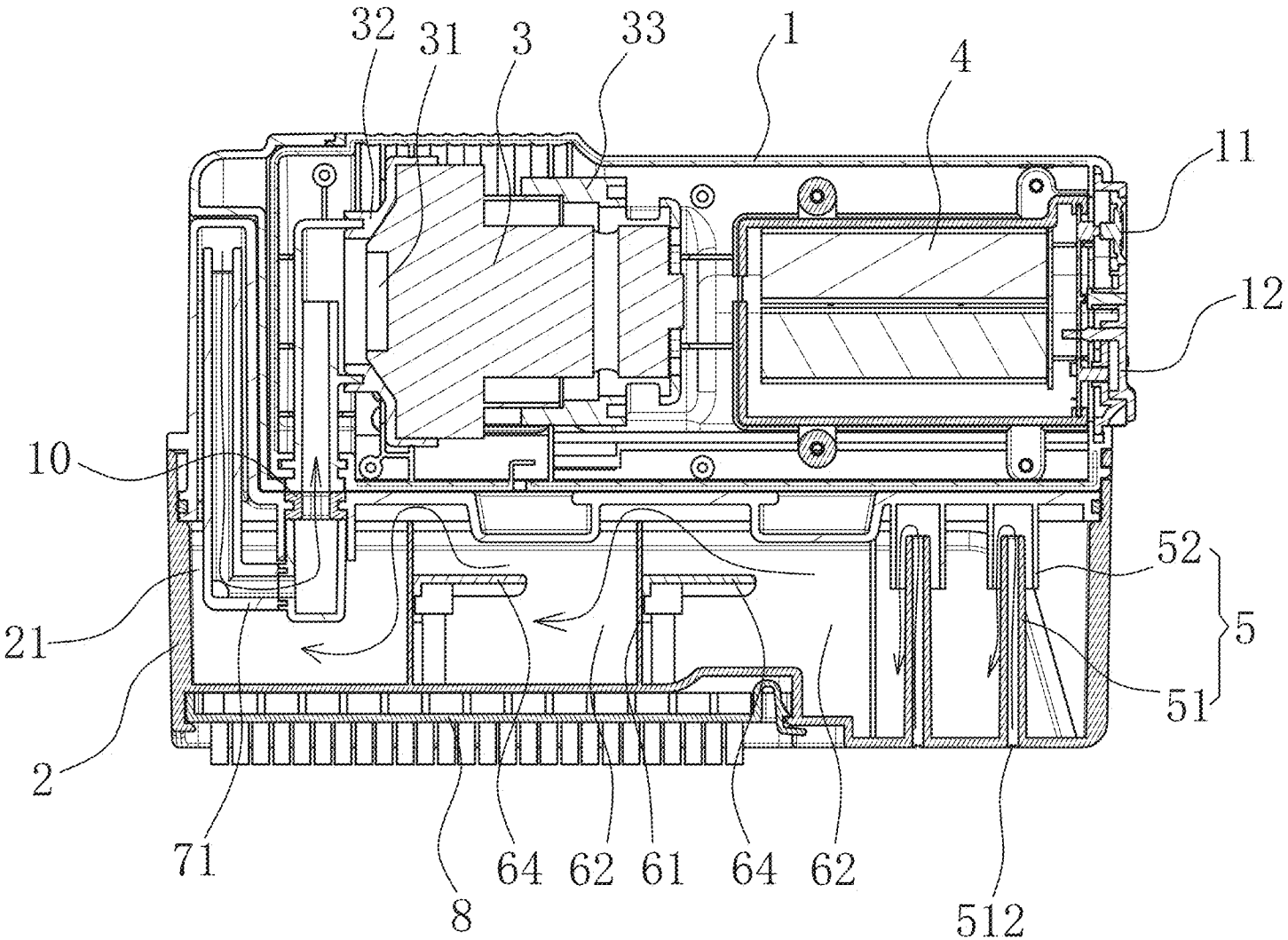
FIG. 2 is a schematic structural diagram of showing a suction path through an arrow sign in FIG. 1.

The rear channel 5 includes a water suction pipe 51 vertically arranged on an inner bottom surface of the sewage tank 2 and side plates 52 arranged on an inner top surface of the sewage tank 2 and located on two sides of the water suction pipe 51. In this embodiment, as shown in FIG. 1, the water suction pipe 51 directly extends upward from the inner bottom surface of the sewage tank 2 to form a connecting structure, while the side plates 52 directly extend downward from the inner top surface of the sewage tank 2 to form the connecting structure. A water suction hole 511 axially running through the water suction pipe 51 is provided inside the water suction pipe 51, a lower end of the water suction hole runs through the bottom surface of the sewage tank 2 to form the water suction opening 512, and water suction gaps 521 are formed between the side plates 52 and the water suction pipe 51. In this ways, the rear channel 5, as indicated by an arrow in FIG. 2, is an inverted U-shaped trajectory channel that may be formed together by the water suction opening 512, the water suction hole 511, and the water suction gaps 521 that are sequentially in communication.

Certainly, a quantity of rear channels 5 may be designed according to an actual situation. For example, in this embodiment, two rear channels 5 are arranged. The two rear channels are arranged side by side and communicate with each other. Each rear channel 5 has the water suction opening 512 formed by running through the bottom surface of the sewage tank 2, to form independent water suction. The water suction opening may be designed into a long hole shape, to facilitate rapid suction of sewage.

For the middle channel 6, a plurality of spacers 61 are sequentially arranged along a horizontal direction in a middle part of the sewage tank 2. A compartment 62 is formed between every two adjacent spacers. Communication is formed between every two adjacent compartments through a spacing 63 at a top of the spacer 61. Therefore, actually, every two compartments 62 and a spacing 63 at a top of the spacer 61 that spaces the compartments apart, as indicated by the arrow in FIG. 2, just constitute an inverted U-shaped trajectory channel.

A quantity of compartments 62 may be determined according to an actual design. For example, in this embodiment, two compartments 62 are arranged side by side, and a baffle 64 is provided in each compartment 62. The baffle is a horizontal plate formed at a middle part of the spacer 61 in a connecting manner, and is always arranged on a front side of the compartment, that is, at the middle part of the spacer 61 on a left side of the compartment shown in FIG. 1. In this way, not only circulation between adjacent compartments 62 through the spacing 63 may not be blocked, but also sewage in the sewage tank 2 cannot be easily sucked into a next compartment 62, so that the sewage can be more effectively blocked and stored inside sewage tank 2.

The front channel 7 is a U-shaped pipe 71 arranged inside the sewage tank 2, the side channel 21 is formed between the U-shaped pipe and an inner sidewall of the sewage tank 2, one end opening of the U-shaped pipe 71 runs through the top surface of the sewage tank 2 to form the air outlet 72, and an other end opening of the U-shaped pipe 71 is in communication with the side channel 21.

In this way, the compartment 62 at a rearmost end of the middle channel 6 directly communicates with the rear channel 5, and the compartment 62 at a foremost end of the middle channel 6 communicates with the front channel 7 through the side channel 21.

Figure 3:
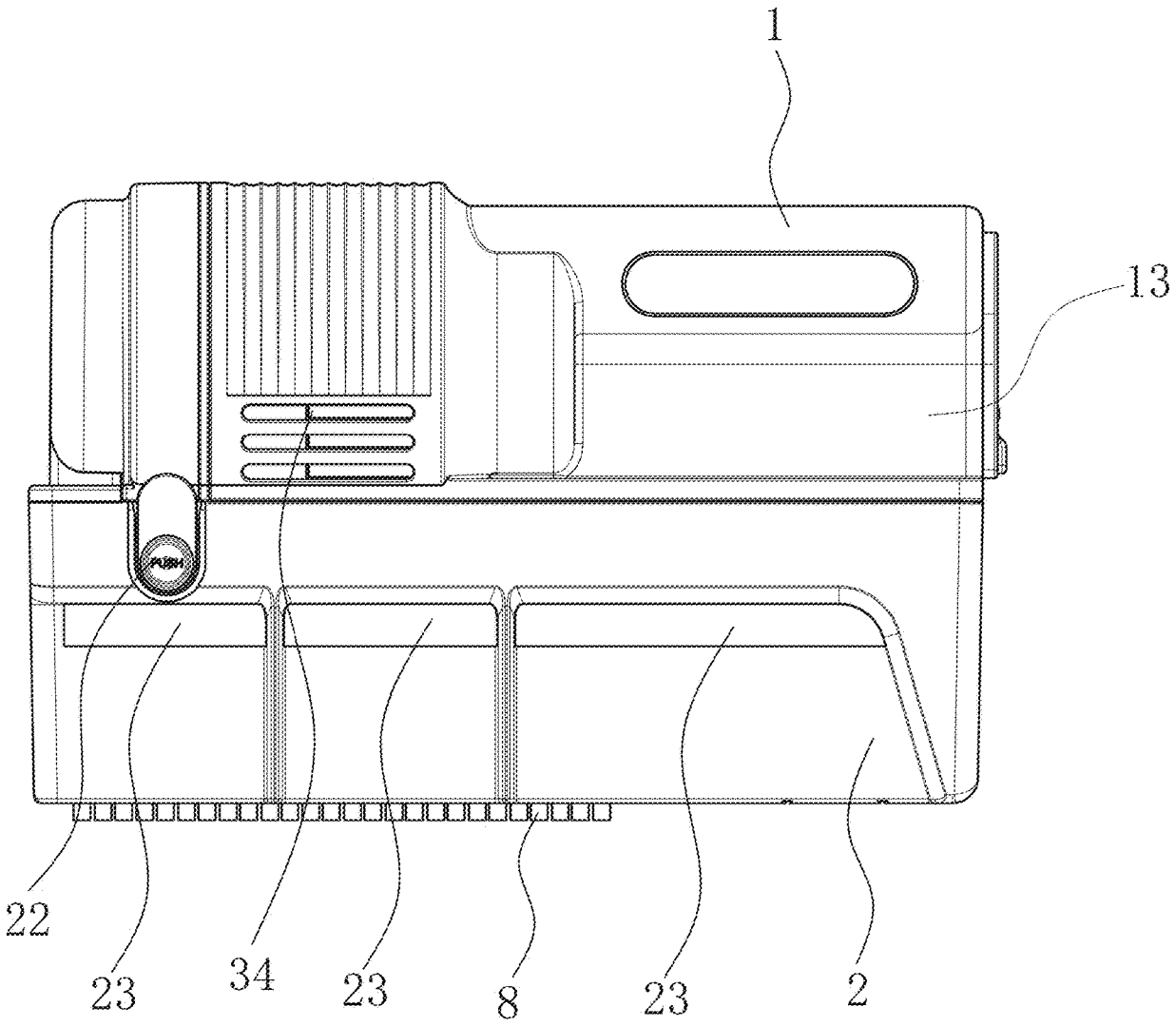
FIG. 3 is a schematic structural diagram of the present invention of FIG. 1.
Figure 4:
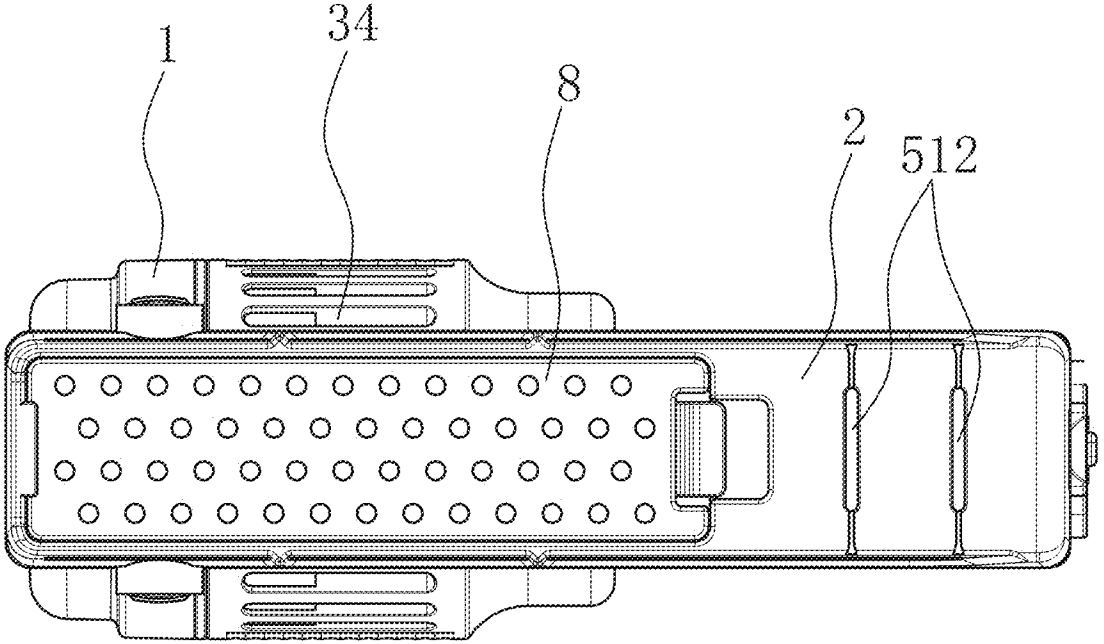
FIG. 4 is a bottom view of FIG. 3.
Figure 5:
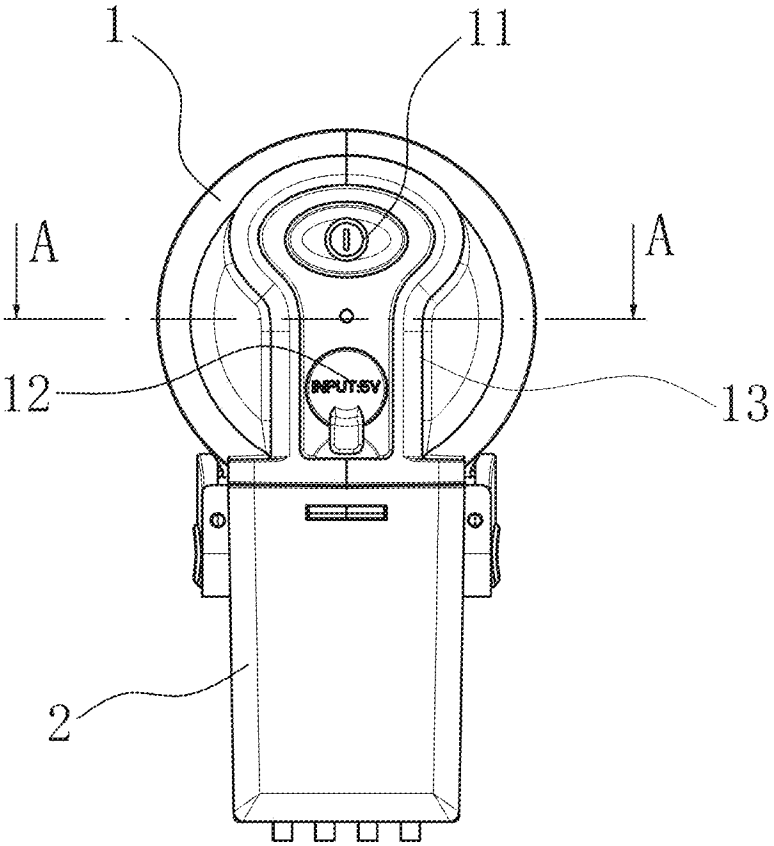
FIG. 5 is a right view of FIG. 3.
Figure 6:
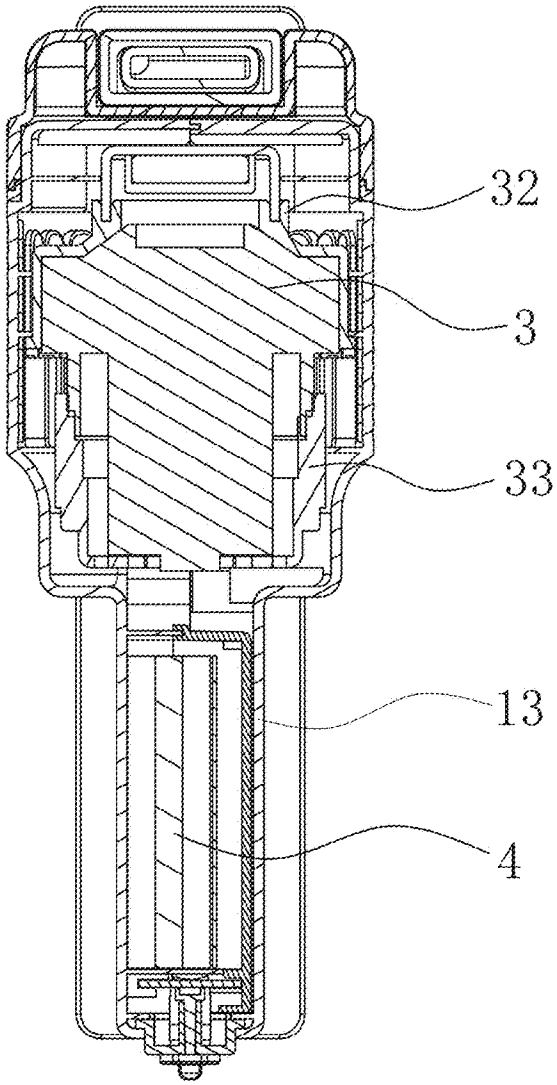
FIG. 6 is a cross-sectional view of FIG. 5 along A-A.

In addition, a disassembly button 22 and a plurality of labels 23 distinguished by different colors are arranged on an outer surface of the sewage tank 2. The disassembly button 22 facilitates an operation of quick disassembling the sewage tank 2 at the bottom of the housing 1. Moreover, the plurality of labels 23 enable a user to intuitively distinguish water level conditions of chambers inside the sewage tank 2. As shown in FIG. 3 of this embodiment, labels 23 in a total of three colors are designed. That is, a chamber in which the front channel 7 is located is identified by a red label 23, a front-side chamber of the middle channel 6 is located is identified by a yellow label 23, and a rear-side chamber of the middle channel 6 and a chamber in which the rear channel 57 is located are jointly identified by a green label 23. Certainly, the color, forms, or sizes of the labels 23 are not limited. In this way, the user can better grasp the water level conditions of the chambers through the labels 23, and can perform handling in time when a water level reaches a warning position.

An air suction channel 9 is arranged inside the housing 1, and the air suction channel is in communication with the air suction opening 31 of the motor 3 and the air outlet 72 of the sewage tank 2 respectively, that is, the air outlet 72 of the sewage tank and the air suction fuopening 31 of the motor form sealed communication, to provide a negative-pressure suction force for an interior of the water suction channel 9.

An embedded and fixed sealing plug 10 is arranged at the air outlet 72, and the air outlet 72 is in sealed communication with the air suction channel 9 through the sealing plug 10. The air suction channel 9, as indicated by the arrow in FIG. 2, is a "⌈"-shaped channel formed together by a vertical channel 91 in communication with the air outlet 72 and a horizontal channel 92 in communication with the air suction opening 31.

Therefore, a suction path of the water suction channel is lengthened by the rear channel 5, the middle channel 6, and the front channel 7, and is further in conjunction with design of the air suction channel 9, while internal structures of the rear channel 5, the middle channel 6, and the front channel 7 are also designed uniquely, to better prevent water vapor in the sewage tank 2 from being directly sucked into the air suction opening 31 and corroding internal devices of the motor 3, thereby ensuring the use reliability of the handheld electric cleaner and extending a service life.

The foregoing descriptions are merely specific embodiments of the present invention, and a person skilled in the art should understand that any structural design equivalent to the embodiments shall fall within the protection scope of the present invention.

What is claimed is:

1. A handheld electric cleaner, comprising: a housing, a motor and a battery inside the housing, and a sewage tank outside the housing, wherein the sewage tank is provided with a water suction opening and an air outlet, a water suction channel that is in communication with the water suction opening and the air outlet respectively is arranged inside the sewage tank, and the air outlet of the sewage tank is in sealed communication with an air suction opening of the motor, and provides a negative-pressure suction force for an interior of the water suction channel, wherein the water suction channel comprises a rear channel, a middle channel, and a front channel that are sequentially in communication; the rear channel runs through a bottom surface of the sewage tank to form the water suction opening; and the middle channel is in communication with the front channel through a side channel inside the sewage tank, and the front channel runs through a top surface of the sewage tank to form the air outlet.

2. The handheld electric cleaner according to claim 1, wherein the rear channel comprises a water suction pipe vertically arranged on an inner bottom surface of the sewage tank and side plates arranged on an inner top surface of the sewage tank and located on two sides of the water suction pipe, a water suction hole axially running through the water suction pipe is provided inside the water suction pipe, a lower end of the water suction hole runs through the bottom surface of the sewage tank to form the water suction opening, and water suction gaps are formed between the side plates and the water suction pipe; and the rear channel is an inverted U-shaped trajectory channel formed together by the water suction opening, the water suction hole, and the water suction gaps that are sequentially in communication.

3. The handheld electric cleaner according to claim 1, wherein for the middle channel, a plurality of spacers are sequentially arranged along a horizontal direction in a middle part of the sewage tank, a plurality of compartments are formed with each compartment between every two adjacent spacers, communication is formed between every two adjacent compartments through a spacing at a top of the spacer, and a baffle is arranged inside every compartment.

4. The handheld electric cleaner according to claim 1, wherein the front channel is a U-shaped pipe arranged inside the sewage tank, the side channel is formed between the U-shaped pipe and an inner sidewall of the sewage tank, one end opening of the U-shaped pipe runs through the top surface of the sewage tank to form the air outlet, and an other end opening of the U-shaped pipe is in communication with the side channel.

5. The handheld electric cleaner according to claim 1, wherein an air suction channel is arranged inside the housing, and the air suction channel is in communication with the air suction opening of the motor and the air outlet of the sewage tank respectively.

6. The handheld electric cleaner according to claim 5, wherein the air suction channel is a "⌈"-shaped channel formed together by a vertical channel in communication with the air outlet and a horizontal channel in communication with the air suction opening.

7. The handheld electric cleaner according to claim 5, wherein an embedded and fixed sealing plug is arranged at the air outlet of the sewage tank, and the air outlet is in sealed communication with the air suction channel through the sealing plug.

8. The handheld electric cleaner according to claim 1, wherein the sewage tank is detachably configured at a bottom of the housing, and a cleaning brush that is detachably mounted is arranged at a bottom of the sewage tank.

9. The handheld electric cleaner according to claim 1, wherein the motor is transversely arranged and mounted at a front part of the housing, and an air exhaust opening of the motor is provided on a side surface of the front part of the housing; a grip for a hand to hold is formed at a rear part of the housing, and a motor switch for starting the motor and a charging port for charging the battery are arranged at a rear part of the grip; and the battery is transversely arranged and mounted inside the grip.

10. The handheld electric cleaner according to claim 1, wherein a front sealing ring is arranged at a front part of the motor, a rear sealing ring is arranged at a rear part of the motor, and the motor is sealingly mounted inside the housing through the front and rear sealing rings.

* * * * *